United States Patent [19]

Gaywood

[11] Patent Number: 4,817,891

[45] Date of Patent: Apr. 4, 1989

[54] DEPLOYMENT ARRANGEMENT FOR SPINNING BODY

[75] Inventor: John E. Gaywood, Stevenage, United Kingdom

[73] Assignee: British Aerospace Public Limited Company, London, England

[21] Appl. No.: 38,716

[22] Filed: Apr. 15, 1987

[30] Foreign Application Priority Data

Apr. 15, 1986 [GB] United Kingdom ..... 8609166

[51] Int. Cl.[4] ..... F42B 13/32

[52] U.S. Cl. ..... 244/3.23; 244/3.29

[58] Field of Search ..... 244/3.23, 3.29, 3.28; 102/231–235, 237, 238, 241, 243; 188/184

[56] References Cited

U.S. PATENT DOCUMENTS 3,563,495 2/1971 Korn ..... 244/3.29

3,613,594 10/1971 Burke ..... 102/241

3,697,019 10/1972 Watson ..... 244/3.29

4,440,360 4/1984 Hallström ..... 244/3.28

4,709,878 12/1987 Titley ..... 244/3.28

*Primary Examiner*—Deborah L. Kyle

*Assistant Examiner*—Michael J. Carone

*Attorney, Agent, or Firm*—Nixon & Vanderhye

[57] ABSTRACT

A deployment mechanism in which a member 2 deploys from a spinning body 1 by centrifugal force is described.

A friction arm 6 exerts a retarding torque on the root 4 of member 2 and prevents the member from overshooting its deployed position. The friction arm 6 applies a retarding torque which is proportional to the spin rate of the missile and keeps the resultant deployment torque to within pre-determined limits. The mechanism automatically compensates for a wide range of spin rates.

3 Claims, 3 Drawing Sheets

DEPLOYMENT ARRANGEMENT FOR SPINNING BODY

BACKGROUND OF THE INVENTION

This invention relates to arrangements for deploying a member from a spinning body and in particular, though not exclusively to arrangements for deploying a fin from a projectile.

Established deployment mechanisms are known which use high rate springs to deploy fins from the body of a projectile. However stored energy devices can deploy accidentally during handling or storage, due to vibration and temperature cycling over long storage periods and they may also jam during deployment.

BRIEF SUMMARY OF THE INVENTION

According to one aspect of this invention there is provided an arrangement for deploying a member from a spinning body comprising a member deployable under the influence of centrifugal force and retarding means movable under the influence of centrifugal force to apply to said member a friction force retarding deployment. The retarding torque is produced as a function of the prevailing spin rate of the body and the retarding device automatically adjusts to suit a large range of prevailing rates of spin.

Preferably said retarding member is mounted on said body for pivoting movement.

Advantageously said deployable member includes a root portion pivoted on said spinning body and said retarding means is urgable against said root portion to apply said friction force. Preferably said retarding means includes an arm member pivoted at one end of said spinning body and carrying at its other end a bob weight and having adjacent said one end a surface for engaging said root portion. By this arrangement a relatively high friction force is applied using a mechanical lever principle.

Preferably said retarding means are selected such that the torque generated on deployment of said member and the friction torque retarding deployment are such that the kinetic energy of said member when deployed is relatively low.

Conveniently said retarding means is selected such that the torque initially generated on deployment of said member is substantially higher than the friction torque, this reduces the possibility of the member failing to deploy due to stiction. In a specific embodiment of this invention said deployable member is a fin and said spinning body is a projectile.

DESCRIPTION OF THE FIGURES

By way of example a specific embodiment of the invention will now be described, by reference to the accompanying drawings, in which.

DETAILED DESCRIPTION OF THE PREFERRED EMBODIMENT OF THE INVENTION

Figure 1:
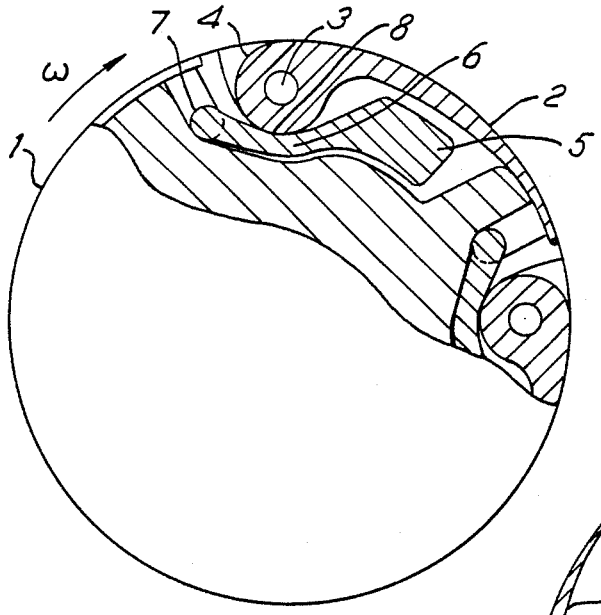
FIG. 1 is a diagrammatic partial section view of the end of the projectile including a fin deployment assembly incorporating features of this invention with the fin in a closed position.
Figure 2:
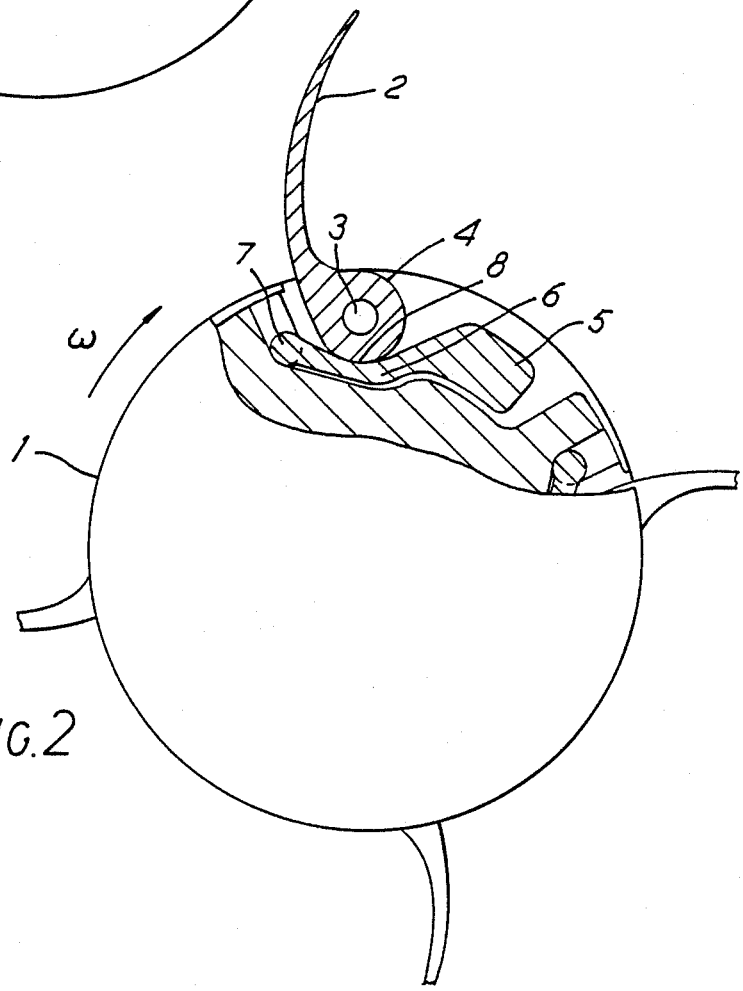
FIG. 2 is a diagrammatic partial section view showing the projectile of FIG. 1 with the fin in a deployed position.
Figure 3:
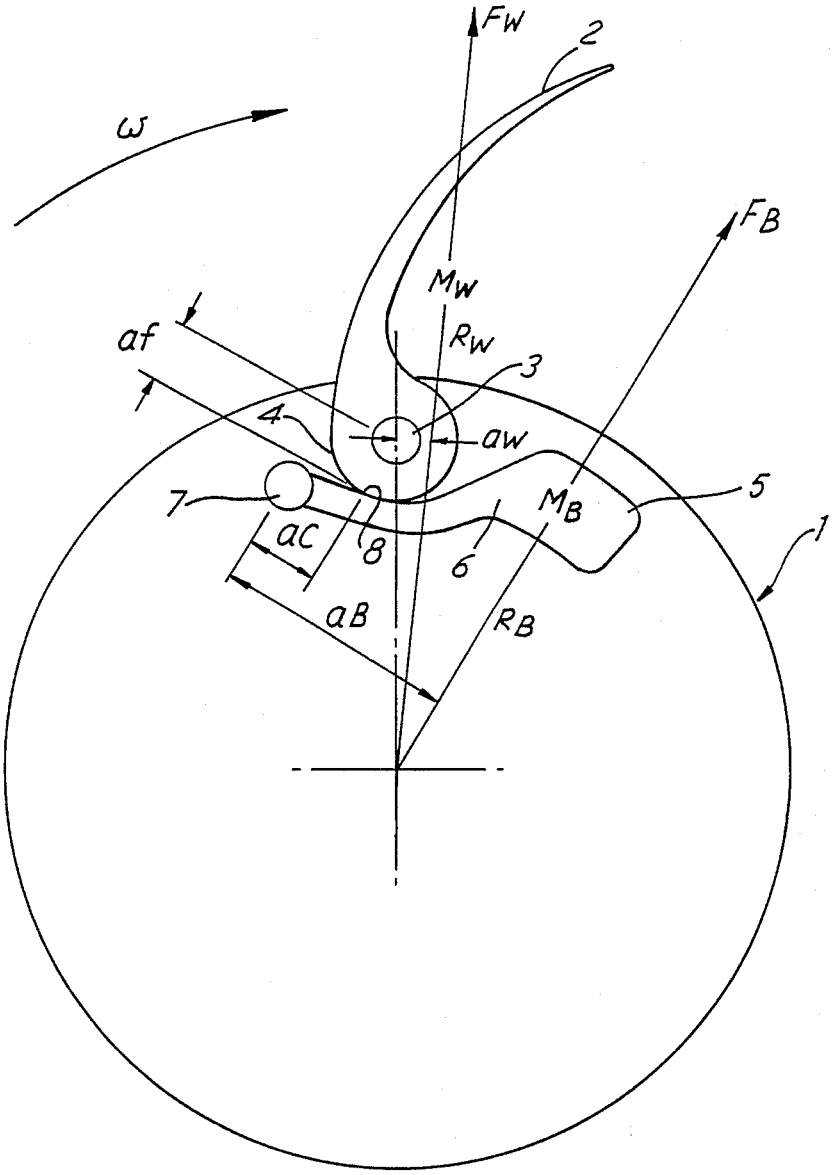
FIG. 3 is a diagrammatic end view of the projectile of FIGS. 1 and 2 with the fin in an intermediate position and identifying certain parameters.

Referring to FIGS. 1 to 3 the projectile illustrated has four fins and is intended to be launched from a gun. Through the initial part of its trajectory the projectile will be spinning at a high rate due to rifling in the gun barrel and the fins are intended to be deployed under centrifugal force to reduce the spin rate. The rate at which the projectile is spinning when the fins are to be deployed will vary considerably due primarily to the size of the propulsion charge. Referring to FIG. 1 the projectile includes a body 1 to which are attached four fins 2, only one of which is shown, for pivotal movement between a closed position in which they lie against the surface of the projectile body (FIG. 1) and an open position (FIG. 2) in which they project laterally from the projectile to stabilise it. Each fin includes a root portion 4 by which it is pivotally attached to the body by means of a pin 3. The remainder of the fin is curved so that it fits within the periphery of the body when in the stored state. A friction arm 6 is associated with each fin 2 and is pivotally attached adjacent one end to the projectile body. The friction arm includes a friction surface 8 for being urged against the root portion 4 of the fin and at its other end a bob weight 5.

In operation, the projectile is launched from a gun and is initially spinning at a high rate, typically 300 Hz. FIG. 3 represents the projectile spinning about its axis in a clockwise direction at a rate of w radians per second but the same mechanism could be arranged to deploy fins from a body which spins in an anti-clockwise direction. During deployment the fin 2 rotates outwardly about pivot 3 under the influence of centrifugal force into a fully deployed position such as that shown in FIG. 2. During rotation of body 1 the friction arm 6 also experiences an outwardly acting centrifugal force thus exerting a substantial friction force on the root of the fin 2. The deployable fin of mass MW is rotatably mounted on pivot 3. When the body 1 spins about its axis at a rate w radians per second in a clockwise direction the fin 2 experiences an outward force $F_w$ shown as acting radially outward from the centre of the body 1 passing through the centre of gravity of the fin and the axis of the projectile. The fin 2 rotates about pivot 3 in an anti-clockwise direction, under the influence of Force $F_w$, until it reaches its deployed position shown in FIG. 2. The friction arm 6 has a mass MB and when the body 1 spins about its axis the arm experiences a force $F_B$ shown as acting radially outward from the centre of the missile through the centre of gravity MB of the friction arm 6. The friction arm applies the centrifugal force it experiences as a retarding torque to the root 4 of fin 2. The retarding force is increased by leverage before it is applied to the fin at a point ac along the friction arm from pivot 7.

The friction arm is designed to apply a braking force to the root of the fin which is sufficient to slow the rotation of the fin but not so great as to prevent the fin from deploying. Because the braking device applies a retarding force which is less than the force of deployment the fin is unlikely to stick during deployment.

The outward force on the fin is defined as:

$$TW = Fw \times aw \quad \text{(Equation I)}$$

where TW = Torque on the fin
Fw = Centrifugal force on fin
aw = moment arm of Fw from pivot 3.

The retarding torque produced by friction arm is defined by $$TR = FB \times (aB/aC) \times mu \times af \quad \text{(Equation II)}$$

where
TR = retarding torque
FB = force on friction arm 6
aB = moment arm of force fB from pivot 7
mu = friction force
af = point of application of friction force from fin root
ac = point of action of friction arm on fin root from pivot 7.

Figure 4:
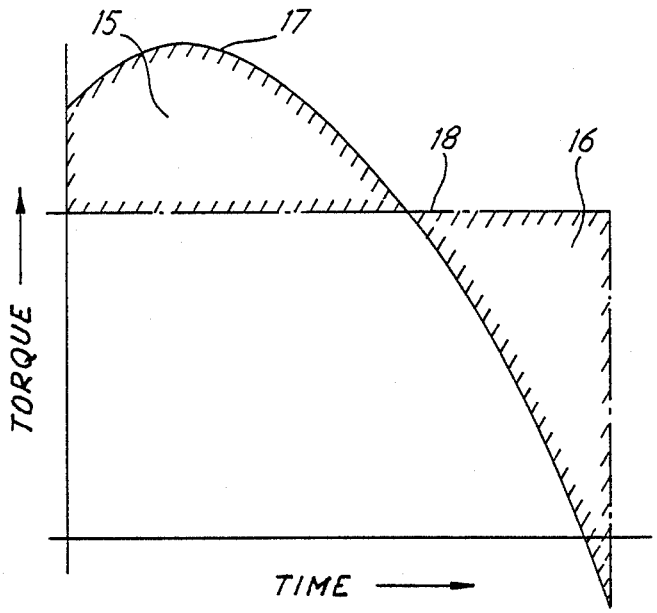
FIG. 4 is a graph representing the typical history for parts of the projectile of FIGS. 1 to 3.

FIG. 4 shows how torque varies with time and it will be seen that the net kinetic energy of the fin once deployed is nil thus no shock or oscillation should occur.

Figure 5:
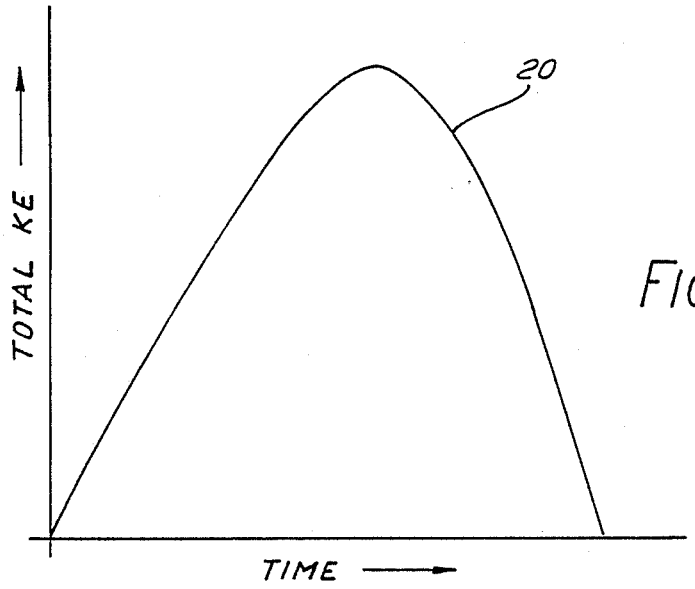
FIG. 5 is a graph representing the energy history for the fin of Figures 1 to 3.

Curve 17 represents the deployment torque which acts outwardly on the projectile fin and line 18 represents the retarding torque applied to the fin root by the friction arm. The areas 15 and 16 bounded by the curve 17 and line 18 represent the deployment energy of the fin and the retarding energy of the friction arm respectively. FIG. 5 represents the net kinetic energy of the fin as it deploys and is retarded by the friction arm in the above arrangement. The arrangement does not use high rate springs and is consequently less prone to mechanical failure during storage or deployment moreover the kinetic energy of the fin is totally dissipated when the fin is fully deployed to prevent it from overshooting its required position. In the above arrangement the root 4 of member 2 is shown as circular but it could be profiled like a cam to achieve a locking action; for example it could be given a flat edge so that member 2 remains in position once it has deployed. Alternatively other types of locking device could be devised to lock fin 2 in place when it has reached its deployed position; for instance a wedge type lock could be used. In the above calculations the aerodynamic loading has been ignored since in the likely deployment environment this represents only about 5% of the total torque applied. While the above arrangement has been described with specific reference to the deployment of fins from a projectile it will be understood that the principles described may be used in other applications where it is wished to match a deployment torque and a retarding torque for a wide range of spin rates; for example deployment mechanisms on board a spinning spacecraft may employ this device.

What is claimed is:

1. A deployment system for deploying a member from a spinning body, said system comprising;

a deployable member having a root portion rotatably mounted on said spinning body to allow rotation of said deployable member from a stowed position to a deployed position under centrifugal force;

said system further comprising retarding means, movable under centrifugal force to apply a spin-rate dependent friction force retarding deployment of said deployable member throughout at least a major portion of the movement of said deployable member to its deployed position, wherein said root portion includes a friction surface extending around at least part of the periphery thereof, and said retarding means is freely movable under centrifugal force and includes a friction surface for frictionally engaging the friction surface of said root portion, wherein said retarding means comprises an arm member having one end pivotally mounted on the spinning body and the other end carrying a bob weight, said arm member being provided with said friction surface intermediate said one end and said weight.

2. A deployment system for deploying a member from a spinning body, said system comprising;

a deployable member having a root portion rotatably mounted on said spinning body to allow rotation of said deployable member from a stowed position to a deployed position under centrifugal force;

said system further comprising retarding means, movable under centrifugal force to apply a spin-rate dependent friction force retarding deployment of said deployable member throughout at least a major portion of the movement of said deployable member to its deployed position, wherein the mass of said retarding means and the mass and center of gravity of said deployable member are selected so that the friction force applied to the deployable member is sufficient to reduce the kinetic energy of the deployable member relative to the body to a relatively low level as the member approaches the deployed position.

3. A deployment system for deploying a member from a spinning body, including a deployable member in the spinning body, said system comprising:

mounting means for allowing rotation of said deployable member from a stowed position to a deployed position under the influence of centrifugal force during spinning of said spinning body; and retarding means, responsive to centrifugal force generated by spinning of said spinning body, for applying a spin-rate dependent friction force and retarding deployment of said deployable member throughout at least a portion of the movement of said deployable member from its stowed position to its deployed position, wherein said said deployable member includes:

a root portion, said root portion including a friction surface etending around at least a portion of a periphery of said root portion; and said retarding means includes a friction surface for engaging said root portion friction surface, wherein said retarding means comprises;

an arm having two ends, one arm end pivotally mounted to said spinning body and another arm end carrying a bob weight, and said retarding means friction surface is located intermediate said ends of said arm.

* * * * *